United States Patent [19]

Kennedy et al.

[11] Patent Number: 4,540,380

[45] Date of Patent: Sep. 10, 1985

[54] TOY VEHICLE HAVING VARIABLE DRIVE

[75] Inventors: Melvin R. Kennedy, New York, N.Y.; Dietmar Nagel, Chester, N.J.; Abraham Arad, Westport, Conn.

[73] Assignee: Nagel, Kennedy, Arad & Associates, New York, N.Y.

[21] Appl. No.: 588,968

[22] Filed: Mar. 13, 1984

[51] Int. Cl.[3] ..... A63H 29/24

[52] U.S. Cl. ..... 446/463; 105/119

[58] Field of Search ..... 446/463, 462, 457, 459, 446/461, 464, 431, 436; 105/119

[56] References Cited

U.S. PATENT DOCUMENTS

| | | | |
|---|---|---|---|
| 461,228 | 10/1891 | Willett | 105/119 |
| 482,594 | 9/1892 | Soley et al. | 105/119 |
| 3,529,479 | 9/1970 | Ryan et al. | 446/463 X |
| 3,634,969 | 1/1972 | Harlting et al. | 446/463 |
| 4,116,084 | 9/1978 | Masuda | 446/463 X |
| 4,152,866 | 5/1979 | Suda | 446/463 |
| 4,306,375 | 12/1981 | Goldfarb et al. | 46/251 |
| 4,467,557 | 8/1984 | Kuna | 446/463 |

*Primary Examiner*—Mickey Yu

*Attorney, Agent, or Firm*—Amster, Rothstein & Engelberg

[57] ABSTRACT

A miniature toy vehicle powered by a single battery operated motor that, through a shiftable transmission, drives the vehicle in a low speed, four-wheel drive mode or in a high speed, two-wheel drive mode. When the motor is in the off position, the transmission is disengaged from the wheels so that the vehicle can free wheel.

7 Claims, 14 Drawing Figures

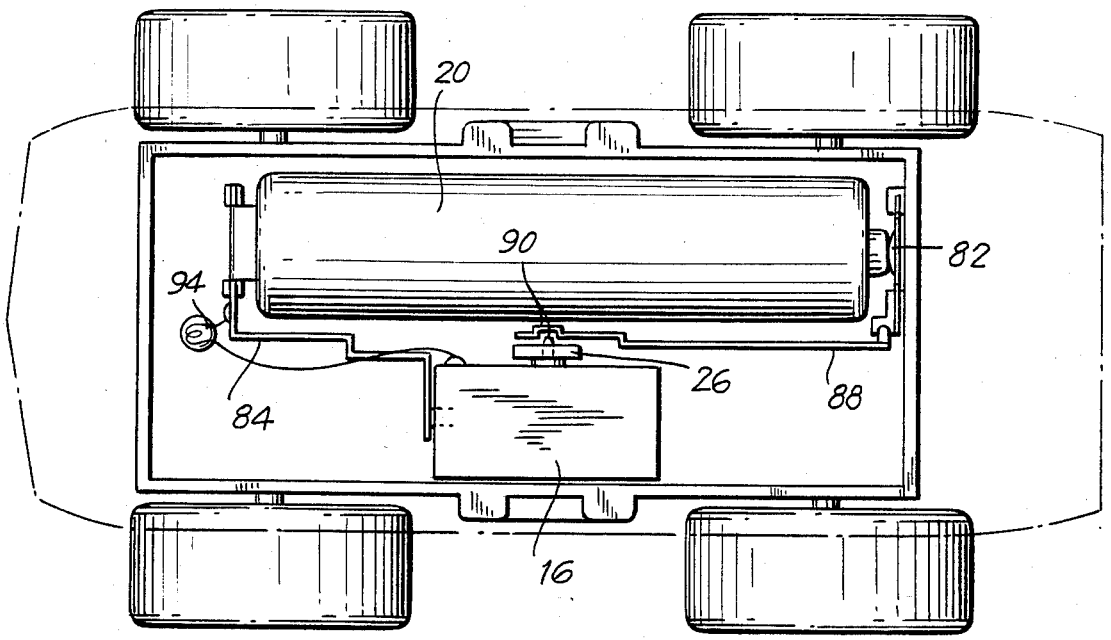
FIG. 6
FIG. 7
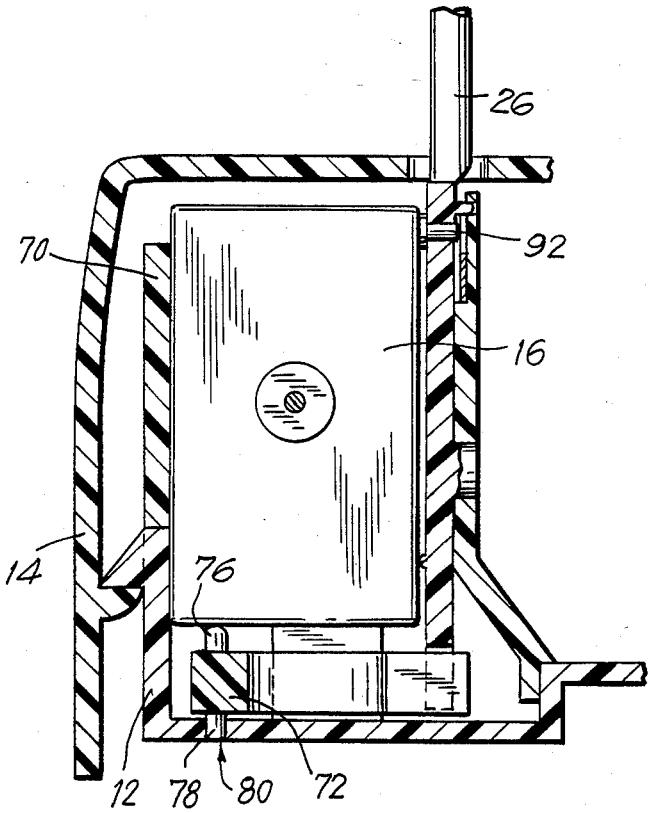

TOY VEHICLE HAVING VARIABLE DRIVE

This invention generally relates to a toy vehicle adapted for two-wheel drive operation, four-wheel drive operation and manual operation.

With the current popularity of off-the-road vehicles, many toys have been designed to simulate the operation of these full-size vehicles. Commercial success of these toys depends on the ability of the toys to perform in a realistic manner and yet sell at an affordable price. To keep the cost of these vehicles down, it is imperative to minimize the quantity of parts needed to satisfactorily operate the toy and advantageous to keep the size of the toy small, which also tends to increase the battery life.

One attempt to make a compact four-wheel drive toy vehicle is disclosed in U.S. Pat. No. 4,306,375 where a double ended motor is used to simultaneously drive the front and rear wheels. This configuration, while effective in four-wheel drive operation has the tendency to exhaust the power of its single AA size battery in a relatively short period of time. Also, since the wheels are constantly engaged with the motor, it is not possible for a child to operate the vehicle by hand when the battery is exhausted. This has the tendency to lead to child frustration and an overall dissatisfaction with the toy, in addition to damage to the gears should the vehicle be propelled by hand when the battery is exhausted.

It was to overcome these problems in the prior art that this invention was made. In particular, it is an object of the present invention to provide a miniature off-the-road toy vehicle with the capability of operating in a four-wheel drive mode, a battery saving two-wheel drive mode and in a free-wheeling mode for use when the battery is exhausted.

It is an overall objective of this invention to provide a miniature off-the-road vehicle which is inexpensive to produce, realistically simulates the operation of commercial two-wheel, four-wheel drive vehicles, and is easy for a child to operate.

It is a specific objective of this invention to provide an inexpensive transmission that will propel the toy vehicle in a two-wheel drive mode, a four-wheel drive mode and disengage the motor from all four wheels so that the toy vehicle can be propelled by hand.

In accordance with the invention, the miniature toy vehicle comprises a chassis containing a motor means and two axles rotatably mounted on the chassis and outfitted with four wheels. Coupling the motor means to the wheels is a transmission means which selectively engages two, four or none of the wheels for two-wheel, four-wheel or free-wheel operation.

In a particular embodiment of the invention and in a first configuration, a small D.C. motor has drive pinions mounted on both ends of a protruding drive shaft, as disclosed in U.S. Pat. No. 4,306,375, which each act to drive a pair of wheels through spur gears that are coaxially formed with worms which in turn drive low speed gears rotatably mounted on each axle. Clutch means mounted on each axle are positioned by a shifting means to selectively engage the low speed gears with their corresponding axles to propel the vehicle by all four wheels.

In a second configuration, a first clutch means is positioned by the shifting means so that a first low speed gear is disengaged from a first pair of wheels, thereby disengaging the first pair of wheels from the motor and allowing the first pair of wheels to freely rotate. A second clutch means is simultaneously positioned by the shifting means so that a second low speed gear is disengaged from a second pair of wheels. However, the shifting means further positions the second low speed gear so that it engages an intermediate gear which is interconnected with larger, high speed gear. The high speed gear is in constant engagement with a drive gear which is interconnected with the second pair of wheels to drive the second pair of wheels, and thus the toy vehicle, at an increased rate.

In a third configuration, the shifting means causes the first and second clutch means to disengage, disengaging the low speed gears from the wheels and allowing the toy vehicle to free-wheel under manual power.

The toy vehicle is equipped with four tires made out of a soft plastic or rubber material and formed with a pronounced tread to aid in the vehicle's traction.

Power to the motor is activated by a control lever which also serves to change the position of the shifting means from one configuration to another. When power to the motor is activated, a small light bulb is illuminated, the light of which is diffused through a clear plastic diffuser to simulate the existence of two headlights on the toy vehicle.

These and other objects of the invention will become more apparent to a worker skilled in the art upon reading the following detailed description taken in conjunction with the drawings, of which:

FIG. 6 is a top view of the toy vehicle with the body removed and the transmission cover partially cut-away to show the electrical circuit of the vehicle;

FIG. 7 is a side sectional view through the motor, control lever, shifting means, chassis and body taken along line 7—7 of FIG. 3;

Figure 1:
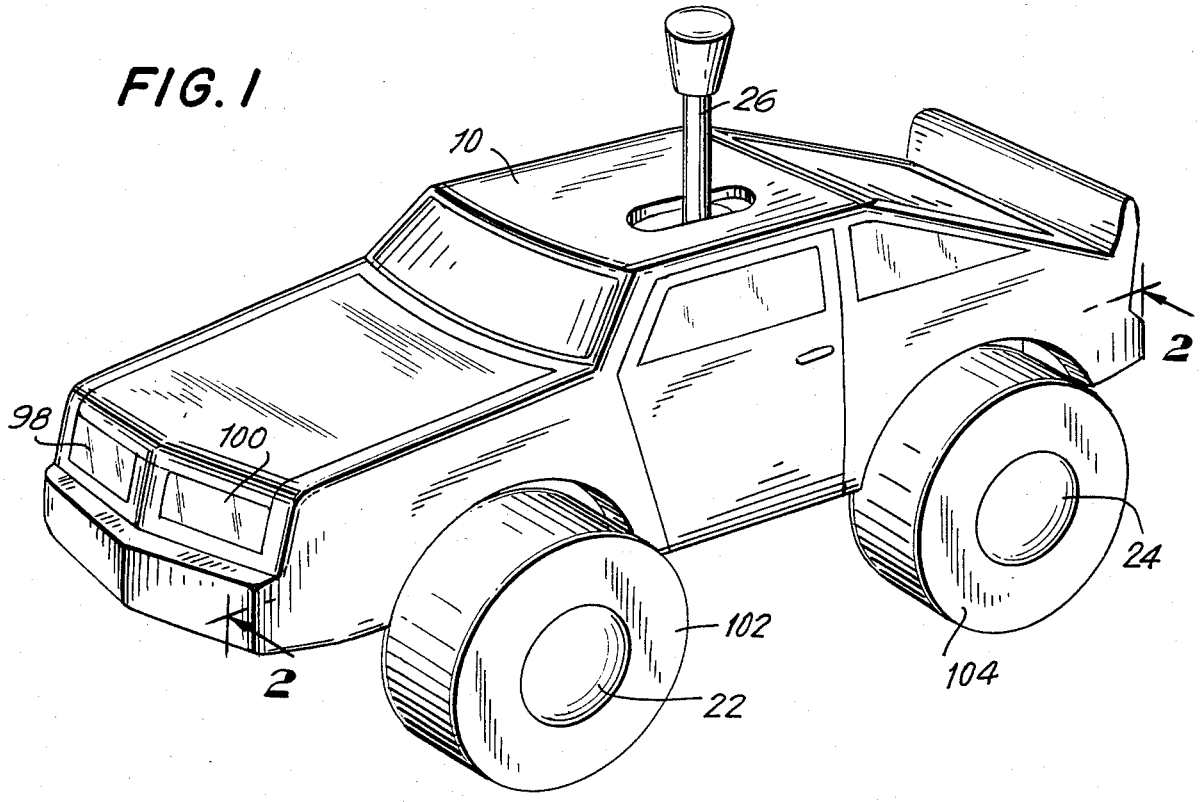
FIG. 1 is an overall view of the toy vehicle.
Figure 2:
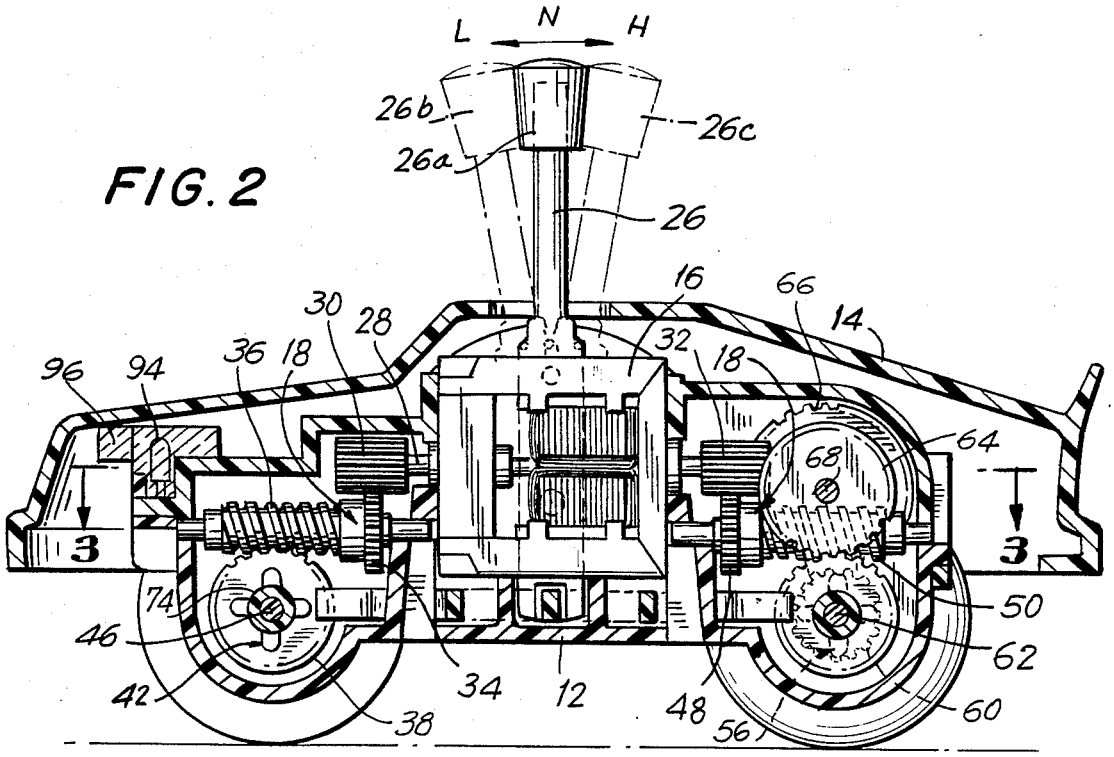
FIG. 2 is a side elevational view taken along line 2—2 of FIG. 1 showing the preferred embodiment of the invention.

Referring now to FIGS. 1 and 2, in a preferred embodiment of the invention, toy vehicle 10 is built on chassis 12 with removable body 14. Body 14 is made of molded plastic and can be formed into any style of vehicle. Chassis 12 houses motor 16, transmission 18 and battery source 20 (shown in FIG. 6). Front wheels 22 and rear wheels 24 are connected to chassis 12 by axles 46 and 62, respectively. Control lever 26 functions to shift transmission 18 into low speed, four-wheel drive position 26*b*, high speed two-wheel drive position 26*c* or neutral, free-wheel position 26*a* and to connect battery source 20 to motor 16. When control lever 26 is in position 26*b* or position 26*c*, motor 16 operates at a constant speed. When control lever 26 is in position 26*a*, motor 16 is inoperative.

Figure 14:
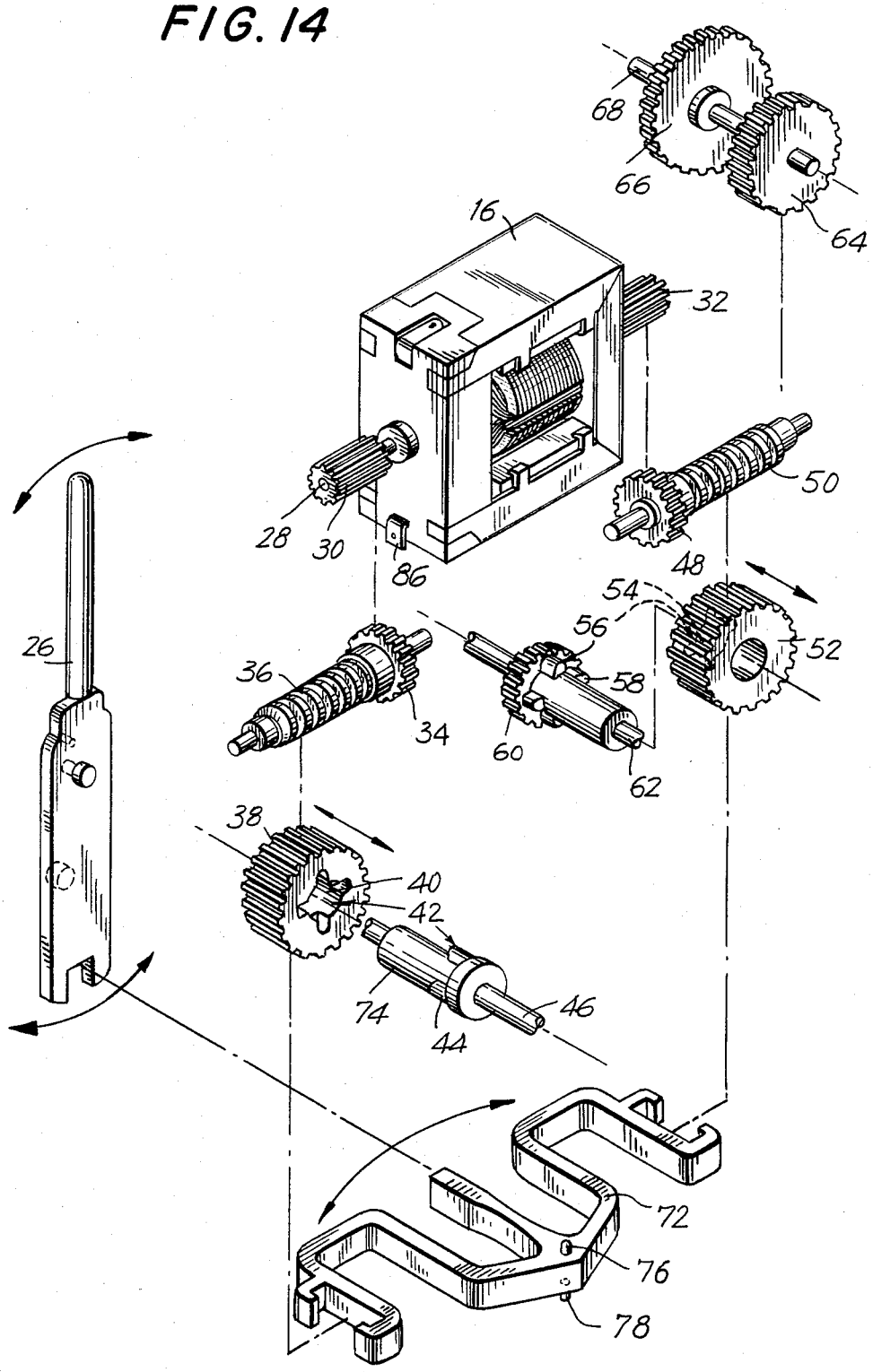
FIG. 14 is an exploded view of the transmissions showing the relationship of the transmission parts to the motor and the control lever.

Referring now to FIGS. 2 and 14, motor 16 is a small D.C. type motor with shaft 28 that protrudes out both ends of motor 16. A first pinion 30 is mounted on one end of shaft 28 and a second pinion 32 is mounted on the other end of shaft 28.

Figure 10:
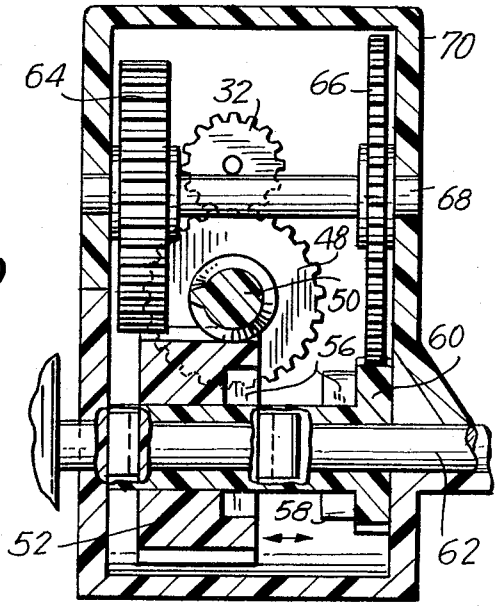
FIG. 10 is a rear view of the drive mechanism for the rear wheels taken along line 10—10 of FIG. 8 shown in the high speed, two-wheel drive position with the rear of the chassis and the transmission cover cut-away for clarity.
Figure 9:
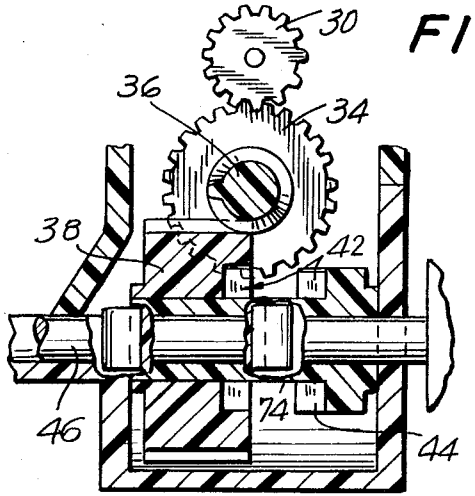
FIG. 9 is a front view of the drive mechanism for the front wheels taken along line 9—9 of FIG. 8 shown in the disengaged two-wheel drive position with the front of the chassis cut-away for clarity.

Transmission 18 consists of a first spur gear 34 which is formed as one piece with first worm 36. First worm 36 is engaged with first low speed gear 38 whose inside diameter 40 comprises the movable female portion of first clutch 42. First clutch 42 has a stationary male portion 44 which is mounted on first axle 46. Second spur gear 48 is formed with second worm 50 and is identical and interchangeable with first spur gear 34 and first worm 36. Second worm 50 is engaged with second low speed gear 52 whose inside diameter 54 comprises the movable female portion of second clutch 56. Second clutch 56 has a stationary male portion 58 which is formed with drive gear 60 and mounted on second axle 62. Intermediate gear 64 and high speed gear 66 are interconnected by shaft 68 and mounted on transmission cover 70 (FIG. 10). Shifting means 72, pivoted about guide means 76 and 78, engages first low speed gear 38 and second low speed gear 52 so that engagement and disengagement of first clutch 42 and second clutch 56 can be simultaneously accomplished by movement of shifting means 72 through control lever 26.

The operation of transmission 18 will be described by referring to FIGS. 2 through 5, 8 through 10 and 11 through 14.

Figure 3:
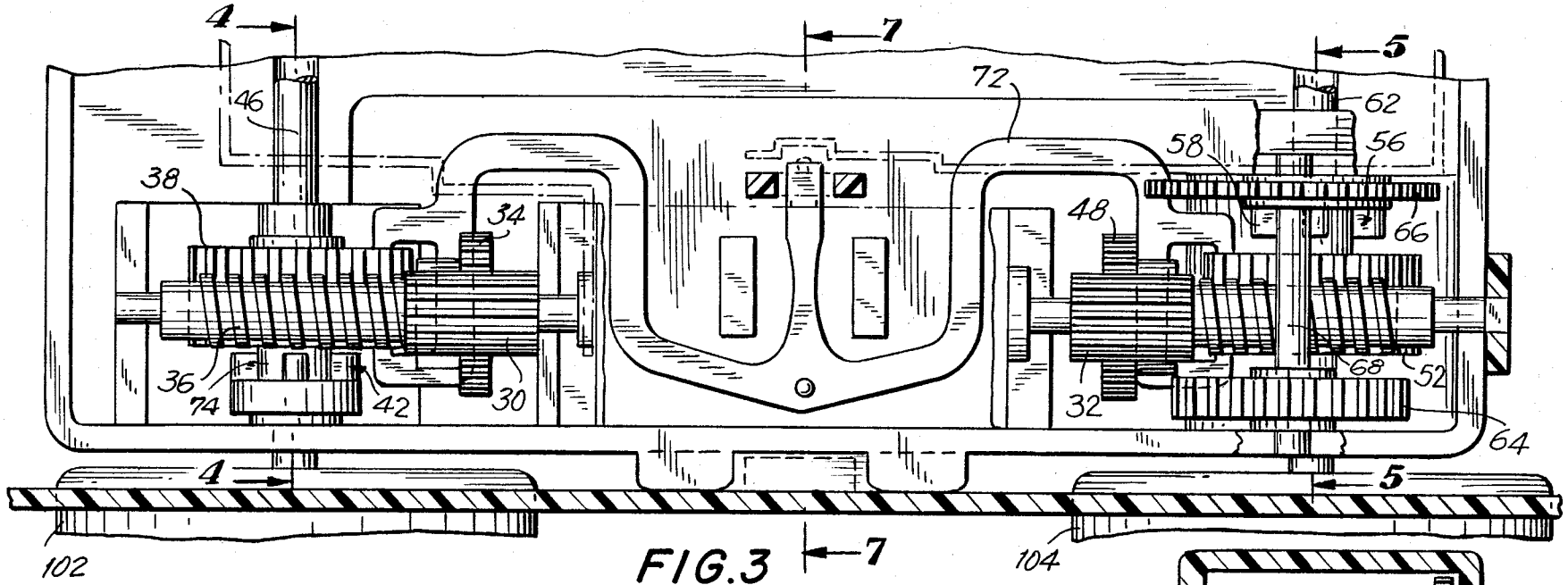
FIG. 3 is a top view of the transmission taken along line 3—3 of FIG. 2 with the motor removed, the transmission cover shown in phantom and the transmission shifted into the neutral, free-wheeling position.
Figure 5:
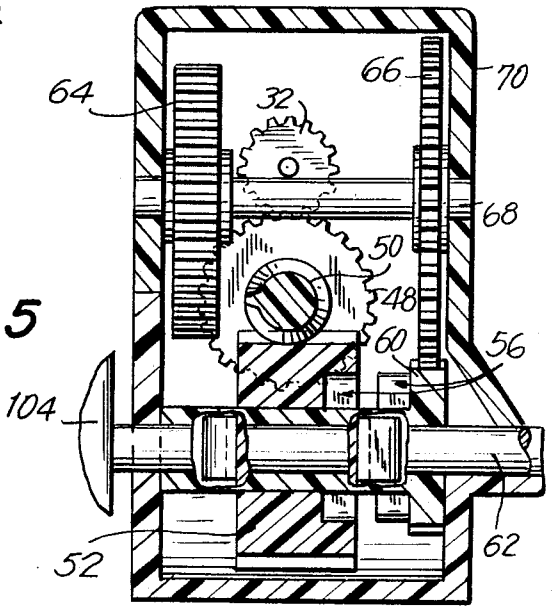
FIG. 5 is a rear view of the drive mechanism for the rear wheels taken along the line 5—5 of FIG. 3 shown in the neutral position with the rear of the chassis and the transmission cover cut-away for clarity.
Figure 4:
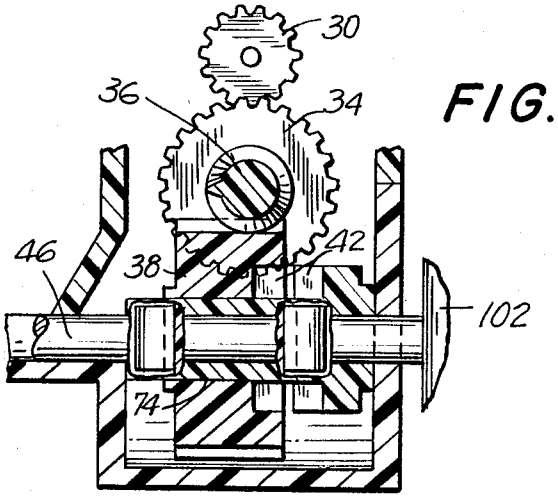
FIG. 4 is a front view of the drive mechanism for the front wheels taken along line 4—4 of FIG. 3 shown in the neutral position with the front of the chassis cut-away for clarity.
Figure 8:
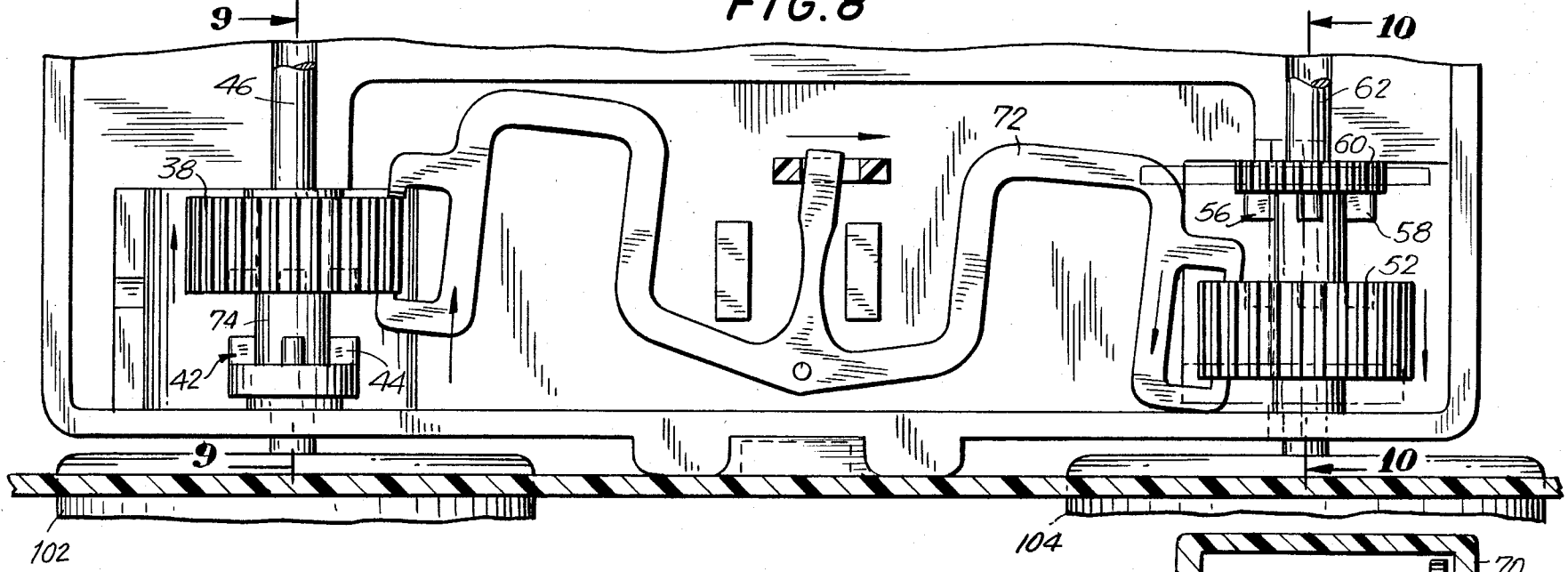
FIG. 8 is a top view of the transmission, similar to that shown in FIG. 3 with the transmission shifted into the high speed, two-wheel drive position.

Referring now to FIGS. 2 through 5 and 14, when toy vehicle 10 is operating with control lever 26 in position 26*a*, motor 16 is not activated and shifting means 72 is positioned as shown in FIG. 3. First pinion 30 and second pinion 32, not being driven by motor 16 do not allow first spur gear 34 and first worm 36 or second spur gear 46 and second worm 50 to turn. First worm 36 and second worm 50, being in constant engagement with first low speed gear 38 and second low speed gear 52, respectively, prohibit first low speed gear 38 and second low speed gear 52 from turning. However, first clutch 42 and second clutch 56 being disengaged allow first axle 46 and rear axle 62 to freely turn without damaging transmission 18. It is interesting to note in FIG. 5 that with second low speed gear 52 positioned in the neutral position, high speed gear 66, which is in constant engagement with drive gear 60 will be driven as toy vehicle 10 is manually propelled. This will not have any adverse effect on transmission 18 since intermediate gear 64 is not engaged with second low speed gear 52 in this configuration.

Referring now to FIGS. 2, 8 through 10 and 14, when control lever 26 is in position 26*c* motor 16 is activated driving first pinion 30 and second pinion 32. Pinion 30 drives first spur gear 34 which in turn drives first low speed gear 38 through first worm 36. Second pinion 32 drives second spur gear 48 and second low speed gear 52 through second worm 50. When control lever 26 is in position 26*c*, shifting means 72 is positioned as that shown in FIG. 8 with both first clutch 42 and second clutch 56 disengaged. This allows front axle 46 to freely turn. First low speed gear 38 is still being driven by first spur gear 34 through first worm 36, although first low speed gear 38 is not causing any movement of toy vehicle 10 but is merely turning on bearing surface 74 which is integrally formed with the male portion 44 of clutch 42. The second low speed gear 52 is being driven by second pinion 32 through second spur gear 48 and second worm 50. However, in high speed position 26*c* clutch 56 is not only disengaged, but second low speed gear 52 is positioned so that it is now engaged with and driving intermediate gear 64 which in turn drives interconnected high gear 66. High gear 66, being constantly in engagement with driven gear 60 propels second axle 62 at a speed of about 30 percent faster then when toy vehicle 10 is operating in four-wheel drive.

Figure 11:
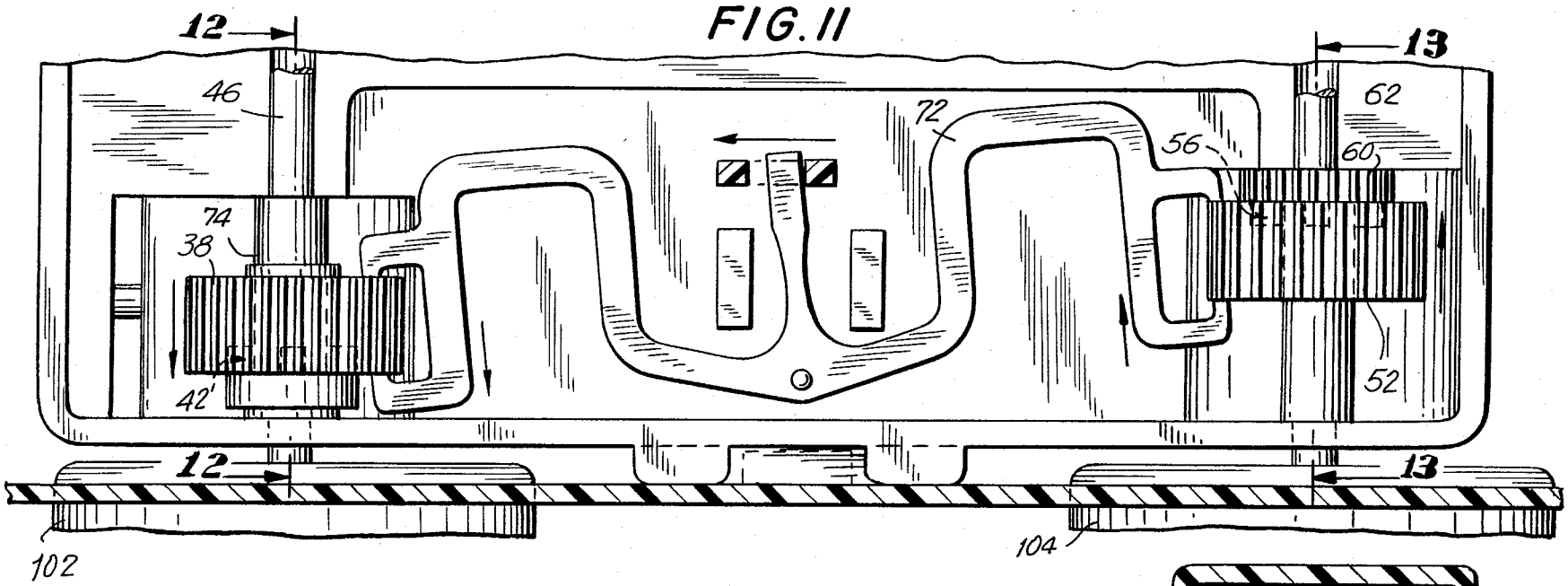
FIG. 11 is a top view of the transmission similar to that shown in FIGS. 3 and 8 with the transmission shifted into the low speed, four-wheel drive position.

Referring now to FIGS. 2, 11 through 13 and 14, when control lever 26 is in position 26*b* motor 16 is activated which in turn drives first pinion 30 and second pinion 32. Shifting means 72 is positioned as shown in FIG. 11 such that first clutch 42 and second clutch 56 are engaged. First low speed gear 38, being driven by first pinion 30 through first spur gear 34 and first worm 36, drives first axle 46. Second low speed gear 52, being driven by second pinion 32 through second spur gear 48 and second worm 50, drives second axle 62 at substantially the same speed as that of first axle 46.

Figure 13:
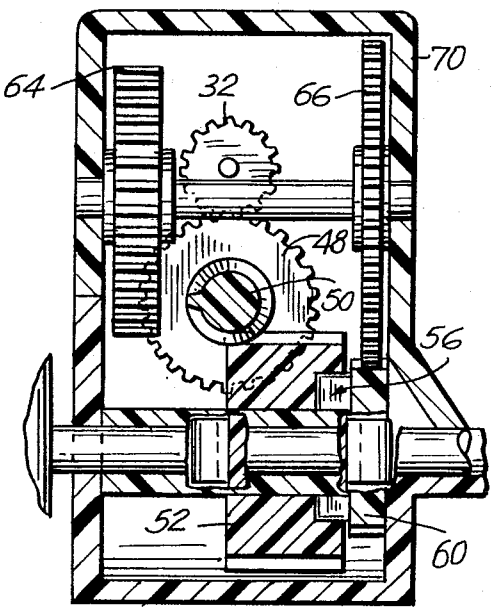
FIG. 13 is a rear view of the drive mechanism for the rear wheels taken along the line 13—13 of FIG. 11 shown in the low speed, four-wheel drive position with the rear of the chassis and the transmission cover cut-away for clarity.
Figure 12:
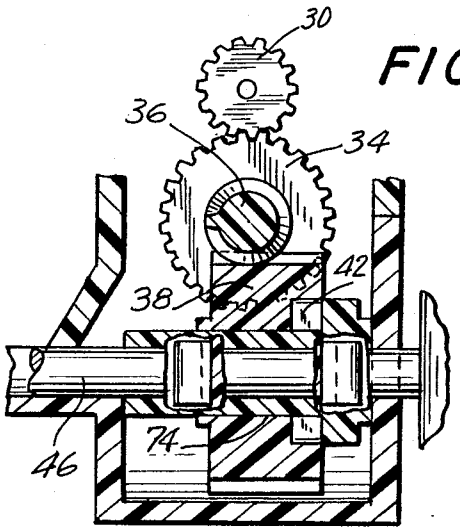
FIG. 12 is a front view of the drive mechanism for the front wheels taken along line 12—12 of FIG. 11 shown in the engaged four-wheel drive position with the front of the chassis cut-away for clarity.

Focusing on FIG. 13, it is interesting to note that intermediate gear 64 is not engaged with second low speed gear 52 but is incidentally being driven by interconnected high speed gear 66 due to the continuous engagement of high speed gear 66 with drive gear 60.

With the exception of first pinion 30 and second pinion 32 all of the clutches, gears and the shifting means are made of inexpensive plastic and as will be appreciated the transmission functions with a minimum number of multi-functional parts.

Referring now to FIG. 7, shifting means 72 pivots about guide means 76 and 78. Guide means 78 is nested in pivot hole 80 located in chassis 12. Through guide means 76, shifting means 72 is maintained in its position by the pressure of motor 16 which is retained in toy vehicle 10 by transmission cover 70 (partially shown in FIG. 7).

Referring now to FIGS. 6 and 7, power to motor 16 is supplied by battery 20 through positive terminal 82 and negative terminal 84 which is connected to motor terminal 86 (FIG. 14) when motor 16 is installed in toy vehicle 10. Switchplate 88, which serves as one side of switch 90, is mounted on transmission cover 70 (not shown in FIG. 6) and is connected to positive terminal 82 when motor cover 70 is installed on toy vehicle 10.

The movable portion of switch 90 is contact point 92, a conducting metal pin which is installed in plastic control lever 26 and which constantly contacts the metal portion of motor 16 which serves as a terminal for one side of the motor circuit. When control lever 26 is positioned in positions 26*b* and 26*c*, contact point 92 touches switchplate 88 completing the power circuit and supplying power to motor 16. When control lever 26 is in position 26*a*, contact point 92 is not touching switchplate 88 and motor 16 is not activated.

Light bulb 94 is connected to negative terminal 84 and to the metal casing of motor 16. When motor 16 is activated, light bulb 94 is illuminated and with diffuser 96 (shown in FIG. 2), a clear plastic block, the light is directed to headlight positions 98 and 100 to simulate the operation of two headlights.

Referring to FIG. 1, front wheels 22 and rear wheels 24 are equipped with front tires 102 and rear tires 104 which are formed out of a soft plastic or rubber material with a pronounced tread to aid in the traction of toy vehicle 10.

While what has been described is the presently preferred embodiment of the invention, it will be apparent to those skilled in the art that modifications and changes can be made to the invention while keeping within the spirit and scope thereof which is set forth in the appended claims.

I claim:

1. A miniature toy vehicle comprising a chassis, a first axle rotably mounted to said chassis, a first pair of wheels installed on said first axle, a second axle rotably mounted to said chassis, a second pair of wheels installed on said second axle, a motor means mounted to said chassis, a transmission means mounted to said chassis and drivingly connected to said motor means and an activating means mounted to said chassis, said transmission comprising a first low speed gear rotably mounted on said first axle, a first clutch means, mounted on said first axle and selectively engaging said first low speed gear with said first axle, a second low speed gear rotably mounted on said second axle, a drive gear installed on said second axle, a second clutch means mounted on said second axle and selectively engaging said second low speed gear with said drive gear, a first spur gear drivingly engaged with said motor means, a first worm co-axially mounted with said first spur gear and drivingly connected to said first low speed gear, a second spur gear drivingly engaged with said motor means, a second worm co-axially mounted with said second spur gear and drivingly engaged with said second low speed gear, an intermediate gear selectively engaged with said second low speed gear, a high speed gear interconnected with said intermediate gear and continuously engaged with said drive gear, and shifting means connected to said first and second low speed gears and adapted to selectively engage and disengage said first and second clutch means; said transmission having a first configuration wherein said shifting means is positioned to cause said first clutch means and said second clutch means to be engaged for four-wheel drive operation; and a second configuration wherein said shifting means is positioned to cause said first clutch means to be disengaged allowing said first pair of wheels to free-wheel and to cause said second clutch means to be disengaged while urging said second low speed gear into engagement with said intermediate gear to drive said second pair of wheels at high speed.

2. A miniature toy vehicle as disclosed in claim 1 wherein said shifting means has a third configuration such that said first clutch means and said second clutch means are disengaged and said second low speed gear is not engaged with said intermediate gear for free-wheel operation of said toy vehicle.

3. A miniature toy vehicle as disclosed in claims 1 or 2 wherein said motor means comprises an electric motor driven by a battery source mounted on said chassis, said motor having a drive shaft extending beyond both ends of said motor, said drive shaft having a first pinion mounted on one end and drivingly engaged with said first spur gear and a second pinion mounted on a second end and drivingly engaged with said second spur gear.

4. A miniature toy vehicle as disclosed in claims 1 or 2 wherein the shifting means comprises a symmetrical fork pivoted about an axis by said activating means.

5. A miniature toy vehicle as disclosed in claim 2 wherein said activating means simultaneoulsy operates to supply power to said motor means and to shift said shifting means into said first, second and third configurations.

6. A miniature toy vehicle comprising a chassis, a first axle rotatably mouted to said chassis, a first pair of wheels installed on said first axle, a second axle rotatably mounted to said chassis, a second pair of wheels installed on said second axle, motor means mounted to said chassis, transmission means mounted on said chassis and drivingly connected to said motor means and activating means mounted to said chassis, said transmission comprising a first clutch including a stationary member mounted on said first axle and a movable member integrally formed with a first low speed gear and rotatably mounted on said first axle, a second clutch including a stationary member mounted on said second axle and a movable member integrally formed with a second low speed gear and rotatably mounted on said second axle, means for translating power to said first and second low speed gears, a drive gear integrally formed with said stationary member of said second clutch and mounted on said second axle, a high speed gear continuously engaged with said drive gear, an intermediate gear interconnected with said high speed gear and selectively engaged with said second low speed gear, and shifting means operatively connected to said first and second low speed gears and including guide means adapted to pivotally mount said shifting means to said chassis for axial movement of said shifting means about said guide means, said transmission having a first configuration wherein said shifting means is pivoted about said guide means axially shifting said first low speed gear and said movable member of said first clutch into engagement with said stationary member of said first clutch and simultaneously axially shifting said second low speed gear and said movable member of said second clutch into engagement with said stationary member of said second clutch for four-wheel drive operation; and, a second configuration wherein said shifting means is pivoted about said guide means axially shifting said first low speed gear and said movable member of said first clutch out of engagement with said stationary member of said first clutch and simultaneously shifting said second low speed gear and said movable member of said second clutch out of engagement with said stationary member of said second clutch and into engagement with said intermediate gear to drive said second pair of wheels at high speed while allowing said first pair of wheels to free-wheel.

7. A miniature toy vehicle as disclosed in claim 6 wherein said transmission has a third configuration such that said shifting means is pivoted about said guide means axially shifting said first low speed gear and said movable member of said first clutch out of engagement with said stationary member of said first clutch and simultaneously shifting said second low speed gear and said movable member of said second clutch out of engagement with said stationary member of said second clutch for free wheel operation.

* * * * *